United States Patent [19]

Fewell et al.

[11] 3,999,602

[45] Dec. 28, 1976

[54] MATRIX HEAT EXCHANGER INCLUDING A LIQUID, THERMAL COUPLANT

[75] Inventors: Thomas E. Fewell; Charles T. Ward, both of Chattanooga, Tenn.

[73] Assignee: The United States of America as represented by the United States Energy Research and Development Administration, Washington, D.C.

[22] Filed: Oct. 21, 1975

[21] Appl. No.: 624,509

[52] U.S. Cl. ..... 165/104 R; 165/104 M; 165/157; 165/164; 165/172

[51] Int. Cl.[2] ..... F28D 13/00

[58] Field of Search ..... 165/104 R, 104 M, 104 F, 165/110, 157, 158, 141, 164, 172

[56] References Cited

UNITED STATES PATENTS

| | | | |
|---|---|---|---|
| 2,578,917 | 12/1951 | Bisch | 165/164 X |
| 3,306,353 | 2/1967 | Burne | 165/164 |

*Primary Examiner*—Edgar W. Geoghegan

*Attorney, Agent, or Firm*—Dean E. Carlson; Arthur A. Churm; Hugh W. Glenn

[57] ABSTRACT

A tube-to-tube heat exchanger is disclosed with a thermally conductive matrix between and around the tubes to define annuli between the tubes and matrix. The annuli are filled to a level with a molten metal or alloy to provide a conductive heat transfer path from one tube through the matrix to the second tube. A matrix heat exchanger of this type is particularly useful for heat transfer between fluids which would react should one leak into the second.

13 Claims, 6 Drawing Figures

MATRIX HEAT EXCHANGER INCLUDING A LIQUID, THERMAL COUPLANT

CONTRACTUAL ORIGIN OF THE INVENTION

The invention described herein was made in the course of, or under, a contract with the U.S. ENERGY RESEARCH AND DEVELOPMENT ADMINISTRATION.

BACKGROUND OF THE INVENTION

The present invention relates to an improvement in matrix heat exchanger construction. These heat exchangers are appropriate where it is desirable to maintain two fluid streams between which heat is to be transferred within separated conduit courses. Heat is conducted from one conduit or tube to the other through a solid medium or matrix surrounding the conduits or tubes. Matrix heat exchangers are to be distinguished from shell and tube, concentric tube and other heat exchanger designs in which process fluids flow through courses separated by a single wall or barrier through which heat is transferred and leaks can result in intermixing of the process fluids.

Matrix heat exchangers are often considered for use in heat-transfer applications involving liquid metal to water or steam. Such applications might include steam generators, steam superheaters or steam reheaters employed in conjunction with liquid-metal-cooled nuclear reactors. Since sodium and sodium-potassium liquid metals are often employed as primary coolants, it is of upmost importance that such reactive metals not be allowed into contact with water or steam in the unlikely event of an accidental leak. A matrix heat exchanger design can be used to minimize the possibility of a liquid metal and water reaction.

A number of limitations have arisen in the design of previous matrix heat exchangers. In some constructions the matrices and tubes have been provided in close, intimate contact such as by casting the matrix material in molten state around an assemblage of tubes or by mechanically bonding e.g. expanding the tubes, into a previously formed matrix. Such constructions may be subject to separation or cracking of the tubes and/or matrix during thermal expansion and contraction produced by high-temperature process cycles. Even very narrow gaps or spaces formed between the tubes and matrix can greatly impair heat transfer. Under same circumstances thermal cycling with resulting contraction and expansion of the tubes may produce a ratchet-like or jacking effect in which tubes slowly work out of the matrix.

In other forms of construction a solder or film is deposited on external surfaces of the tubes prior to assembly. The solder is then made molten or soft to flow into any voids which may exist between the tube and matrix. This type construction depends on the adherence of the solder to the matrix and conduit to prevent gaps. When the solder becomes soft or molten it may not adequately fill existing gaps or it may separate and bead up to produce other gaps with poor conductive coupling between the tubes and matrix. Solder or alloys exhibiting low surface tension and/or inability to wet the tube and matrix materials may be particularly susceptable to such interstitial gap formation.

SUMMARY OF THE INVENTION

Therefore, in view of these limitations of prior-art, matrix heat exchangers, it is an object of the present invention to provide a matrix heat exchanger having improved thermal coupling between the tubes and the heat exchanger matrix.

It is a further object to provide a continuous, thermal couplant for conductive heat transfer over a substantial portion of the interfacing surfaces between the tubes and matrix.

It is also an object to provide a matrix heat exchange with minimum convection and redeposition of dissolved materials between tubes passing relatively hot and cold process fluids.

In accordance with the present invention, a matrix heat exchange unit includes tubes or conduits defining separate courses for passing first and second fluids between which heat is to be transferred. A matrix of a thermally conductive solid includes passageways for receiving individual conduits. The passageways within the matrix are of greater transverse dimensions than the conduits so as to define annular volumes therebetween. A column of a thermally conductive, couplant liquid is filled within each annular volume in intimate contact with both the conduit walls and the matrix to provide a continuous path of thermal conductance therebetween over a substantial portion of the length of the conduits.

BRIEF DESCRIPTION OF THE DRAWINGS

The present invention is illustrated in the accompanying drawings wherein.

DETAILED DESCRIPTION OF THE PREFERRED EMBODIMENT

Figure 1:
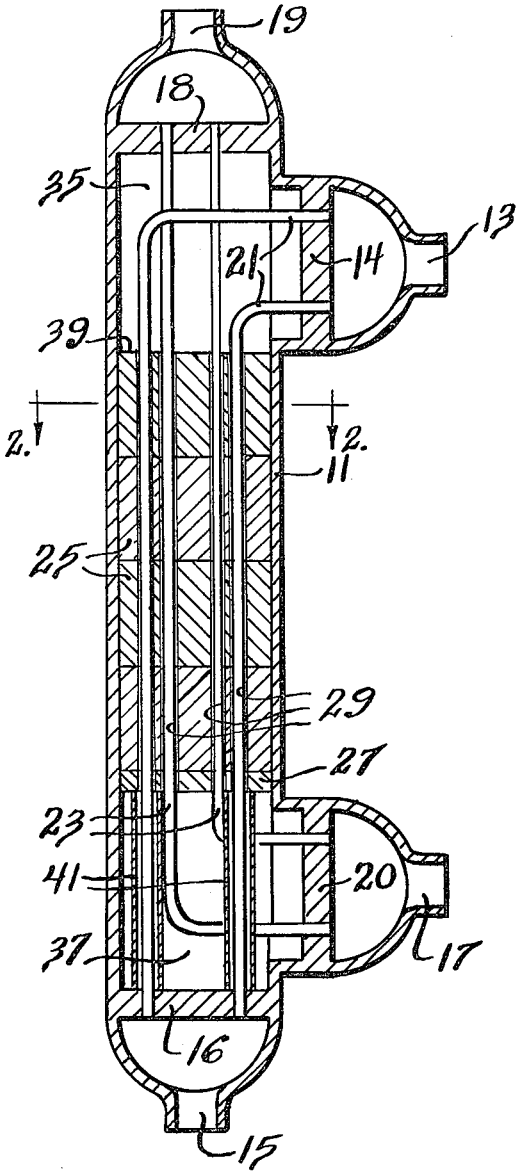
FIG. 1 is an elevation view in cross section of a matrix heat exchanger.
Figure 2:
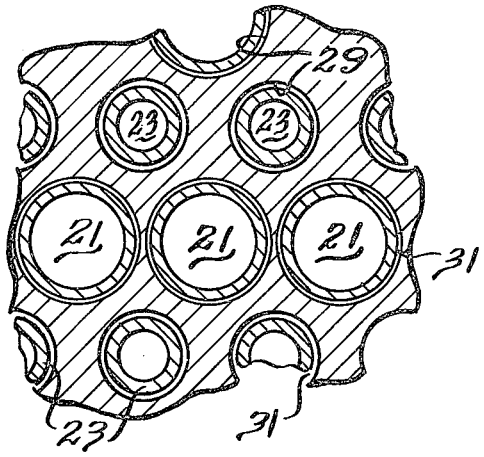
FIG. 2 is a fragmentary view taken at plane 2—2 of FIG. 1.

Referring to the drawings, particularly FIGS. 1 and 2, a matrix heat exchange unit is shown with an outer shell or housing 11 having an inlet 13 and an outlet 15 for flow of a primary fluid and an inlet 17 and outlet 19 for flow of a secondary fluid. A plurality of primary conduits 21 extend between suitable distribution plates 14 and 16 at inlet 13 and outlet 15 respectively for flow of the primary fluid while a plurality of secondary conduits 23 similarly extend between distribution plates 18 and 20 at secondary fluid inlet 17 and secondary fluid outlet 19.

The central portion of the heat exchanger contains a solid, thermally conductive, matrix material 25 shown supported on a matrix support plate 27 affixed within the lower portion of the heat exchanger housing 11. Matrix 25 can be a single piece or in sections as illustrated to facilitate assembly.

A plurality of longitudinal passageways 29 are provided through matrix 25 and support plate 27. Each of the passageways 29 is illustrated receiving a single conduit 21 or 23 in a generally coaxial arrangement. Passageways 29 are provided with a sufficiently large transverse dimension, that is diameter or radius, to receive conduits 21 and 23 in a spaced relationship. Annular volumes 31 are thereby defined intermediate the outer walls of each conduit and the inner walls of each pasageway (see FIGS. 2 and 3).

Figure 3:
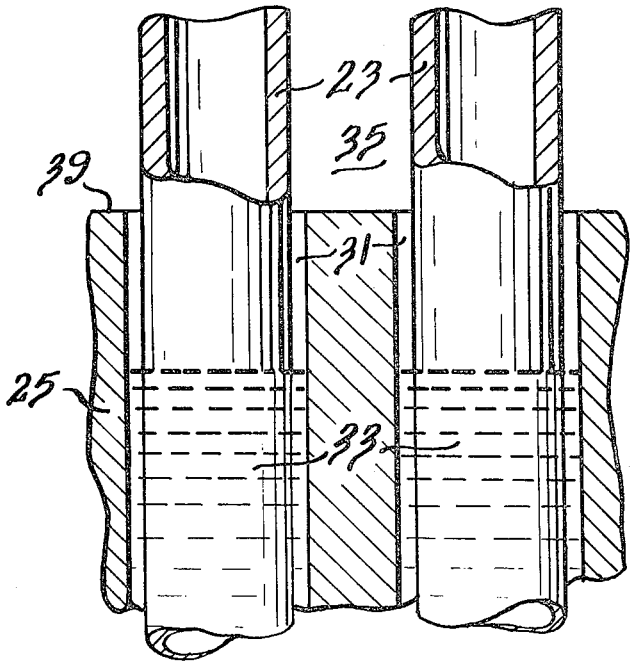
FIG. 3 is a fragmentary cross section in elevation showing an upper portion of the matrix in the heat exchanger of FIG. 1.
Figure 4:
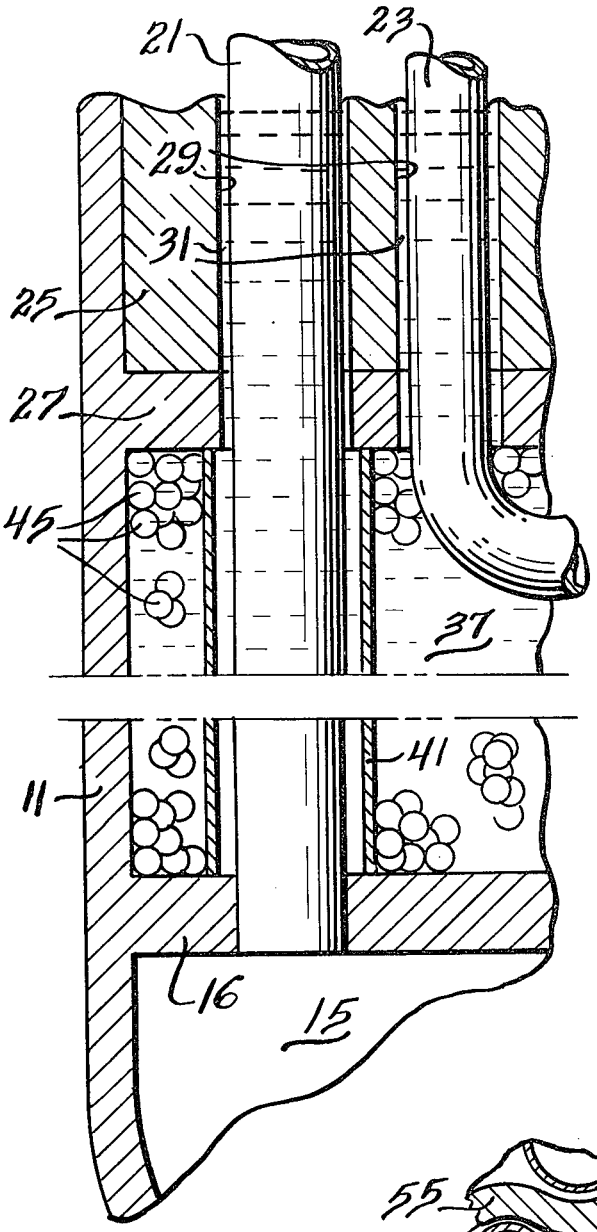
FIG. 4 is an enlarged and more detailed, fragmentary cross section of a portion of a heat exchanger similar to that shown in FIG. 1.

Annular volumes 31 are of sufficient net radius or width to permit filling and draining of a column of a thermally, conductive, liquid couplant 33. For clarity in the drawings, liquid couplant 33 is not shown in FIGS. 1 and 2, but is illustrated in FIGS. 3 and 4. The net radii of the annular volumes 31 will, of course, be selected in respect to the particular properties of the liquid couplant chosen. The liquid surface tension and the ability of the liquid couplant to wet the matrix and conduit materials are considered in arriving at a sufficiently wide annular volume to permit both filling and draining. It is expected that for the liquid metals and alloys considered herein that annular volumes having a net radius, that is clearance between the walls of the passageways 29 and conduits 21 or 23, on the order of about one half to two millimeters will be sufficient.

Above matrix 25 within housing 11 is shown a headspace or upper plenum 35 in which conduit turns are contained. Upper plenum 35 can be filled with inert gas for pressure equilization. In the lower portion of housing 11 below matrix support plate 27 a lower plenum 37 can be provided in communication with each of the annular volumes 31. Plenum 37 and annular volumes 31 are filled with the liquid couplant 33 to a level somewhat below the uppermost surface 39 of matrix 25.

The upper level of liquid couplant 33 should be sufficiently below uppermost level 39 of the matrix 25 to prevent overflow of the liquid couplant 33 from the various annular volumes 31 into upper plenum 35 as a result of thermal expansion and/or contraction during process changes. Through use of this arrangement at the upper levels of the matrix, convection and redeposition of dissolved structural materials between conduits of different temperatures can be minimized. Merely by way of example, about one to two percent of the annular volume 31 height may be left unfilled when Pb-Bi liquid couplant is selected. Typically, this corresponds to about 15 to 30 cm. around the upper portion of a 15 meter conduit.

Since the lower portion of the heat exchange unit plenum 37 is filled with the couplant liquid, other measures can be provided to minimize convection of structural material between relatively hot and relatively cool heat exchanger conduits. In FIG. 1 and, more particularly in FIG. 4, cylindrical sleeves 41 are illustrated concentrically about each of the primary fluid conduits 21. Sleeves 41 are ordinarily disposed about the conduits passing the higher temperature fluid. The sleeves 41 are sufficiently spaced from the concentric conduits 21 to continue annular volumes 31 below the matrix support plate 27. The diameters of sleeves 41 are sufficient to provide enough temperature drop from the conduits to the outer surfaces of the sleeves to substantially reduce the solubility of the sleeve material within the liquid couplant. For example, sodium primary coolant at about 450° C. discharged from the heat exchange unit where it is used to superheat steam from about 370° C. could be passed through conduits equipped with sleeves to reduce the temperature difference to about 50° to 60° C. between the sleeves 41 and secondary conduit 23 in the lower plenum 37.

Also illustrated in FIG. 4 are particulate packing material 45 that occupies a large portion of plenum 37 volume. Packing 45 are preferably particles of spherical shape to accommodate expansion and contraction of the conduits without wedging together. The packing material 45 is of particular importance when scarce and/or expensive couplant liquids such as bismuth alloys are selected for use.

Figure 5:
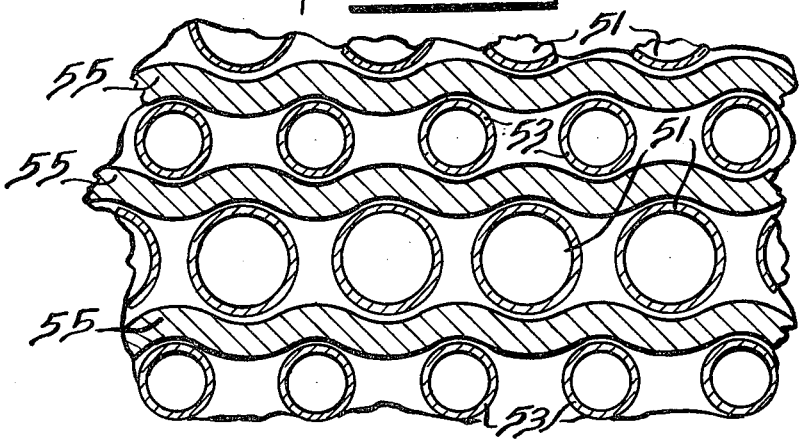
FIG. 5 is a fragmentary cross section showing a modification to the FIG. 1 heat exchanger.

Turning now to FIG. 5 where a modification of the above described embodiment is shown. FIG. 5 illustrates a cross section of primary conduits 51 and secondary conduits 53 passing through the lower or the upper plenum of a heat exchange unit. Corrugated or fluted plates or sheets 55 are fitted between the primary and secondary conduits as illustrated in order to maintain conduit spacing and to prevent convection of material from the hotter to the cooler conduits in the lower plenum. These corrugated sheets 55 also serve to prevent erosion of conduits containing the primary fluid should steam-leak jetting occur. In this application the sheets provide time for emergency action before a $H_2O$-liquid metal reaction can result and are therefore useful within the upper plenum 35 as well as in the lower plenum 37 shown in FIG. 1.

Figure 6:
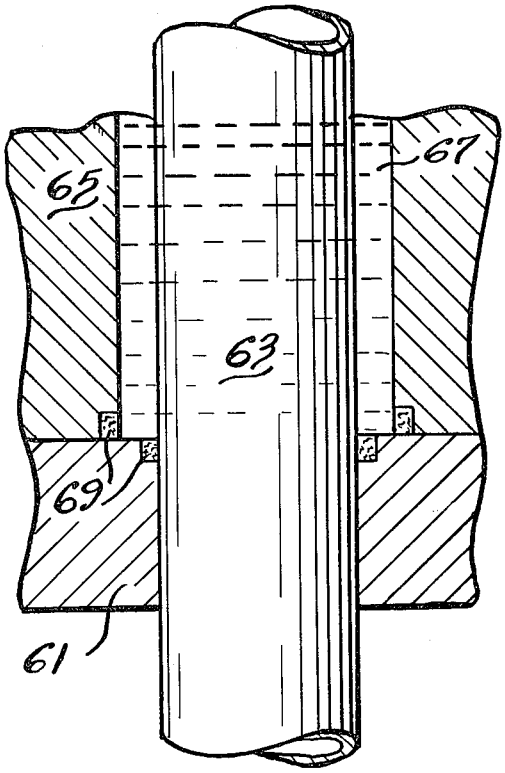
FIG. 6 is a fragmentary, sectional view in elevation of yet another modification to the FIG. 1 embodiment.

One manner of isolating the liquid couplant within each of the annular volumes around respective conduits is illustrated in FIG. 6. The matrix support plate 61 is provided with openings of sufficient size to closely receive conduits 63. Thus, the annular volumes 67 defined between the matrix 65 and conduit 63 can be closed and suitable sealing means 69 e.g. brazing, soldering, welding, packing, etc., provided at the bottom surface of matrix 65. Where desired means for draining individual, annular volumes can be provided. In this configuration not only are there no courses for material convection between hot and cold conduits but a reduced volume of liquid couplant is needed as the lower plenum is not filled. Pressure equilization in the lower plenum can be achieved with an inert gas supply.

Although the matrix heat exchange unit has been described in respect to a few specific embodiments, it should be clear that various other modifications can be incorporated in accordance with the present invention. As an example, heat exchangers with a multiplicity of passes and/or a plurality of separate longitudinal matrix sections can be employed. Also, individual passageways through the matrix material can contain one conduit as illustrated or a bundle of conduits passing the same fluid. The conduits are illustrated forming longitudinal courses between upper and lower inlets and outlets but can also be arranged with horizontal, transverse or slanted portions.

In most instances the construction materials selected for use are not critical. They must, of course, be compatible with the process fluids or liquid couplant at the process temperatures.

Matrix 25 should be of a thermally conductive material preferably having a thermal conductivity of about 120 W/m.K or more. Such materials include graphite, Al, Be, Ir, Cu, Ag, Au, Rh, Mo, Ni, W, and alloys including such materials in substantial proportion. Of these, graphite and aluminum alloys appear more promising from availability and cost considerations.

The liquid, thermal couplant selected for the use as a column of liquid within the annular volumes between the matrix passageways and conduits are preferably liquids of relatively low melting points and relatively high thermal conductivities. Various metals that can be considered for use are listed in table I:

TABLE I

LIQUID METALS CONSIDERED FOR THERMAL COUPLANT

| Metal | Melting Pt. °C. | Boiling Pt. °C. | Thermal Cond. W/m.K |
|---|---|---|---|
| Bismuth (Bi) | 271 | 1560 | 15.4 |
| Cadmium (Cd) | 366 | 765 | |
| Cesium (Cs) | 28 | 689 | |
| Gallium (ga) | 29 | 2237 | 31.1 |
| Indium (In) | 156 | 2000 | 43.2 |
| Lead (Pb) | 327 | 1737 | 15.2 |
| Pb - Bi eutectic | 124 | 1670 | 13.8 |
| Lithium (Li) | 164 | 1331 | 47.7 |
| Mercury (Hg) | −38 | 357 | 10.0 |
| Potassium (K) | 63 | 760 | 36.7 |
| Sodium (Na) | 98 | 892 | 64.0 |
| Tin (Sn) | 232 | 2271 | 32.9 |
| Zinc (Zn) | 419 | 906 | 57.4 |

Alloys of even lower melting points can also be formulated through combinations of various of these metals. For instance, sodium-potassium alloys and solders of tin and zinc. Eutectic compositions and other fusible alloys of bismuth and lead with other components such as tin, cadmium and indium can also be formed with suitably low melting points. Examples of such compositions can be found in *Metals Handbook*, Vol. I, "Properties and Selections of Metals", page 864 (American Society for Metals 1961).

Of the molten metals listed in table I, bismuth, lead mercury and alloys of these materials, particularly bismuth and lead, appear to be preferable for use in high temperature applications. Also, bismuth-lead alloys having between about 48 to 55 weight percent Bi exhibit little change in volume during solidification. These preferred liquid couplants and their alloys unlike sodium, potassium and mixtures thereof are not violently reactive with water should process leaks occur. In addition, corrosion of steels by bismuth, lead and mercury is largely a dissolution process. It takes place due to the solubility difference between the solubility of components in the steel and their solubility in the liquid metal. The resulting dissolution can provide a thermal convection loop of structural materials resulting in mass transfer from the relatively hot to the relatively cold conduits or other portions exposed to the thermal liquid couplant. This mass transfer or thermal convection of structural materials can be impeded by the various structural configurations described above for this purpose or by the addition of inhibitors within the liquid couplant.

Various inhibitors or inhibiting agents can be added to a liquid couplant material to form a protective coating on exposed surfaces of the heat exchange unit. Where lead bismuth alloys are selected as the liquid couplant zirconium, titanium and magnesium have been found to be preferable inhibiting agents. In this application magnesium will simply act as an oxygen getter or deoxidant while zirconium or titanium will form an intermetallic diffusion barrier on the material surfaces. Effective concentration of such inhibitors are expected to be about 300 parts per million (ppm).

It will therefore be clear that the present invention provides an improved matrix heat exchanger with a continuous path for conductive heat transfer over a substantial portion of the length of tubes or conduits conveying process fluids of different temperatures. Conductive thermal coupling between the individual conduits and a thermally conductive matrix material is provided by a column of a liquid, thermal couplant in each of the annular volumes intermediate matrix passageways and the conduits disposed in these passageways. Also, configurations for reducing mass transfer of structural materials by convection between hot and cold conduit surfaces are presented along with preferred thermal couplants and applicable inhibiting agents.

The embodiments of the invention in which an exclusive property or privilege is claimed are defined as follows:

1. A heat exchange unit for transferring heat from a first to a second fluid comprising:

a first conduit having walls defining a course for passing said first fluid;

a second conduit having walls for defining a course for passing said second fluid;

a matrix of a thermally conductive solid around the walls of both said first and second conduits to provide a conductive heat-transfer media therebetween over at least a portion of the lengths thereof; and means for supporting said conduits and matrix in fixed relationship;

the improvement wherein said matrix includes passageways of greater transverse dimensions than those of said conduits and said conduits being received in and supported in spaced relationship to said passageways to define annular volumes therebetween; and wherein a thermally conductive, couplant liquid is filled within said annular volumes to form a continuous column of liquid in intimate engagement with said conduit walls and said matrix.

2. The heat exchange unit of claim 1 wherein said couplant liquid includes molten metal.

3. The heat exchange unit of claim 1 wherein said couplant liquid includes molten metal selected from the group of molten metal consisting of Bi, Pb, Hg and alloys thereof.

4. The heat exchange unit of claim 1 wherein said couplant liquid includes Bi-Pb alloy.

5. The heat exchange unit of claim 1 wherein said couplant liquid includes an inhibiting agent for preventing corrosion of said conduit walls.

6. The heat exchange unit of claim 5 wherein said couplant liquid includes molten metal, said conduit walls include iron and said inhibiting agent includes a metal selected from the group consisting of zirconium, magnesium and titanium.

7. The heat exchange unit of claim 1 wherein means are included for impeding convective flow of said couplant liquid between said first and said second conduits.

8. The heat exchange unit of claim 7 wherein a plenum through which said conduits sealingly pass is provided below said matrix in communication with said annular volumes, said plenum and annular volumes being filled with said couplant liquid to a level below the uppermost surface of said matrix.

9. The heat exchange unit of claim 8 wherein at least one of said conduits has a sleeve around the walls thereof, said sleeve extending at least one of said annular volumes into said plenum.

10. The heat exchange unit of claim 8 wherein a partition is included through said plenum between said first and second conduits.

11. The heat exchange unit of claim 8 wherein said plenum includes solid packing material that fills a portion of the volume thereof.

12. The heat exchange unit of claim 8 wherein said annular volumes, associated with each of said conduits, are provided with sealed, lower end portions near the lowermost surface of said matrix and said annular volumes are filled with said couplant liquid to a level below the uppermost surface of said matrix.

13. The heat exchange unit of claim 1 wherein said liquid is a molten alloy comprising Bi and lead with 48 to 56 weight percent bismuth.

* * * * *